US007264449B1

(12) United States Patent
Harned et al.

(10) Patent No.: US 7,264,449 B1
(45) Date of Patent: Sep. 4, 2007

(54) AUTOMATIC LIQUID COLLECTION AND DISPOSAL ASSEMBLY

(75) Inventors: Dick Harned, Perrysville, OH (US); Bill Tusten, Olathe, KS (US)

(73) Assignee: Little Giant Pump Company, Oklahoma City, OK (US)

( * ) Notice: Subject to any disclaimer, the term of this patent is extended or adjusted under 35 U.S.C. 154(b) by 0 days.

(21) Appl. No.: 11/250,642

(22) Filed: Oct. 13, 2005

Related U.S. Application Data

(63) Continuation of application No. 10/383,502, filed on Mar. 7, 2003, now abandoned.

(60) Provisional application No. 60/362,426, filed on Mar. 7, 2002.

(51) Int. Cl.
*F04B 49/02* (2006.01)

(52) U.S. Cl. ..... 417/36; 417/423.3; 417/366

(58) Field of Classification Search ..... 417/423.1, 417/423.3, 423.14, 423.15, 36, 40; 123/509; 137/565.01
See application file for complete search history.

(56) References Cited

U.S. PATENT DOCUMENTS

| | | | | |
|---|---|---|---|---|
| 3,048,900 | A | 7/1962 | Pollak | |
| 3,264,999 | A | 8/1968 | Tutthill | |
| 3,472,168 | A | 10/1969 | Mitsuo Inoue et al. | |
| 3,652,186 | A | 3/1972 | Carter | |
| 3,748,066 | A * | 7/1973 | Sully et al. | 417/423.3 |
| 3,850,550 | A * | 11/1974 | Kaessen | 417/372 |
| 3,972,647 | A | 8/1976 | Niedermeyer | |
| 4,087,204 | A | 5/1978 | Niedermeyer | |
| 4,171,186 | A | 10/1979 | Chapman | |
| 4,228,427 | A | 10/1980 | Niedermeyer | |
| 4,265,262 | A | 5/1981 | Hotine | |
| 4,437,811 | A | 3/1984 | Iwata et al. | |
| 4,455,099 | A * | 6/1984 | Shibasaki | 384/316 |
| 4,456,432 | A | 6/1984 | Mannino | |
| 4,481,781 | A | 11/1984 | Tsukamoto | |
| 4,599,047 | A | 7/1986 | Nowlin et al. | |
| 4,678,403 | A | 7/1987 | Rudy et al. | |
| 4,915,591 | A | 4/1990 | Funke | |
| 5,238,369 | A | 8/1993 | Farr | |
| 5,249,930 | A | 10/1993 | Pacquesi | |
| 5,477,881 | A | 12/1995 | Fujinaka et al. | |
| 5,567,127 | A | 10/1996 | Wentz | |
| 5,674,056 | A | 10/1997 | Yamamoto et al. | |
| 5,713,723 | A | 2/1998 | Hathaway | |
| 5,924,846 | A | 7/1999 | Arnold, Jr. et al. | |
| 5,927,955 | A | 7/1999 | Janesky | |
| 5,984,377 | A | 11/1999 | Struthers et al. | |

(Continued)

*Primary Examiner*—Michael Koczo, Jr.
(74) *Attorney, Agent, or Firm*—Fellers, Snider, et al.; Bill D. McCarthy

(57) ABSTRACT

A liquid collection and disposal assembly for collecting and disposing of drainage liquid, the liquid collection and disposal assembly disposable in a pit and having a basin assembly with a collection cavity, a pump suspended in the collection cavity and a level detector to detect drainage liquid levels in the collection cavity. A controller responds to the level detector to activate the pump at predetermined levels of the drainage liquid to evacuate the drainage liquid. A transparent basin cover is supported on top of a basin member, and an effluent discharge pipe is connected to the basin cover and to a liquid outlet port of the pump, thereby supporting the pump a predetermined distance above the bottom of the collection cavity. The pump has a water jacket through which the discharging effluent passes to cool the motor.

20 Claims, 6 Drawing Sheets

U.S. PATENT DOCUMENTS

| | | | |
|---|---|---|---|
| 6,059,208 | A | 5/2000 | Struthers |
| 6,106,244 | A | 8/2000 | Nakatsukasa et al. |
| 6,149,390 | A | 11/2000 | Fisher et al. |
| 6,276,908 | B1 | 8/2001 | Batchelder et al. |
| 6,309,539 | B1 | 10/2001 | Mayer |
| 6,378,554 | B1 | 4/2002 | Struthers |
| 6,481,973 | B1 | 11/2002 | Struthers |
| 6,491,060 | B2 | 12/2002 | Struthers |
| 6,565,325 | B2 | 5/2003 | Belehradek |
| 6,638,023 | B2 | 10/2003 | Scott |
| 2002/0114702 | A1 | 8/2002 | House |

* cited by examiner

AUTOMATIC LIQUID COLLECTION AND DISPOSAL ASSEMBLY

RELATED APPLICATIONS

This application is a continuation of non-provisional application Ser. No. 10/383,502 filed Mar. 7, 2003 now abandoned, entitled Automatic Sump Pump Assembly, which claims domestic priority under 35 U.S.C. §119(e) to U.S. Provisional Application No. 60/362,426 filed Mar. 7, 2002, entitled Submersible Automatic Pump.

FIELD OF THE INVENTION

The present invention relates generally to pump assemblies, and more particularly but not by way of limitation, to an automatic liquid collection and disposal assembly.

BACKGROUND OF THE INVENTION

Liquid disposal systems are generally used for the evacuation of drainage liquids, usually non-potable wastewater, in a large number of applications. Examples of such applications are found in residence and business building sites that are subject to drainage liquid collection, such as where shallow underground water levels cause wall seepage or where ground water runoff accumulates. Whatever the source of liquid collection, liquid disposal systems find application to pump the collected liquid, which is often non-potable water, to acceptable drainage lines, usually return sewer lines or storm water drainage systems.

Over the past several years, the overall design of pump assemblies for liquid disposal applications has experienced little change. Typically, liquid disposal assemblies can utilize upright, pedestal or fully submersible pumps. Operational pump control has relied upon some form of switch arrangement to detect the presence and level of liquid collected, such as, for example, the level of wastewater in a collection basin. Such switch arrangements have included float rod and ball switches for pedestal pumps; mercury float switches; mechanical float switches; and diaphragm pressure switches. These switch designs have changed little over the past several years and continue to incur well known deficiencies.

Float switch designs are prone to failure due to such factors as wear of mechanical parts; wedging debris entanglement that prevents effective operation; and operational disconnect or maladjustment. With each of these one can expect failure of the pump to maintain a desired liquid level in a collection vessel.

Diaphragm pressure switches rely on the differential movement of a diaphragm having one side exposed to atmospheric pressure and a head pressure on the other side. It is known that such switches can vary in reliability depending on the elevation of the installation, and the breather tubes commonly used to sense atmospheric pressure are often subject to obstruction.

Submersible pumps used in liquid disposal systems are susceptible to failure when the pumping elements become clogged or otherwise frozen. Wastewater reservoirs usually contain debris that is drawn into the pump, and poor pump performance and pump damage follows.

There is a continuing need for an automatic liquid collection and disposal assembly 100 that provides reliable detection of the level of collected liquid and automated control of the pump to reduce the potential for obstruction to the influent of collecting liquid, and which addresses other limitations associated with current prior art assemblies.

SUMMARY OF THE INVENTION

The present application provides an automatic pump assembly for evacuating drainage liquid collected in a pit, the automatic pump assembly having a basin assembly that forms a collection cavity and which is disposable in a pit. A pump is suspended in the collection cavity above the bottom of the basin, and a level detector serves to detect the level of the drainage liquid in the collection cavity. The pump has a liquid level indicator and a controller to activate the motor of the pump at predetermined levels of the drainage liquid.

The basin assembly has a basin member with an open top and a basin cover supported on the top of the basin member to substantially close the open top. An effluent discharge pipe is connected to the basin cover and to the liquid outlet port of the pump assembly to suspend the pump at a predetermined distance above the bottom of the basin member.

The advantages and features of the present invention will be apparent from the following description when read in conjunction with the accompanying drawings and appended claims.

DETAILED DESCRIPTION

Figure 1:
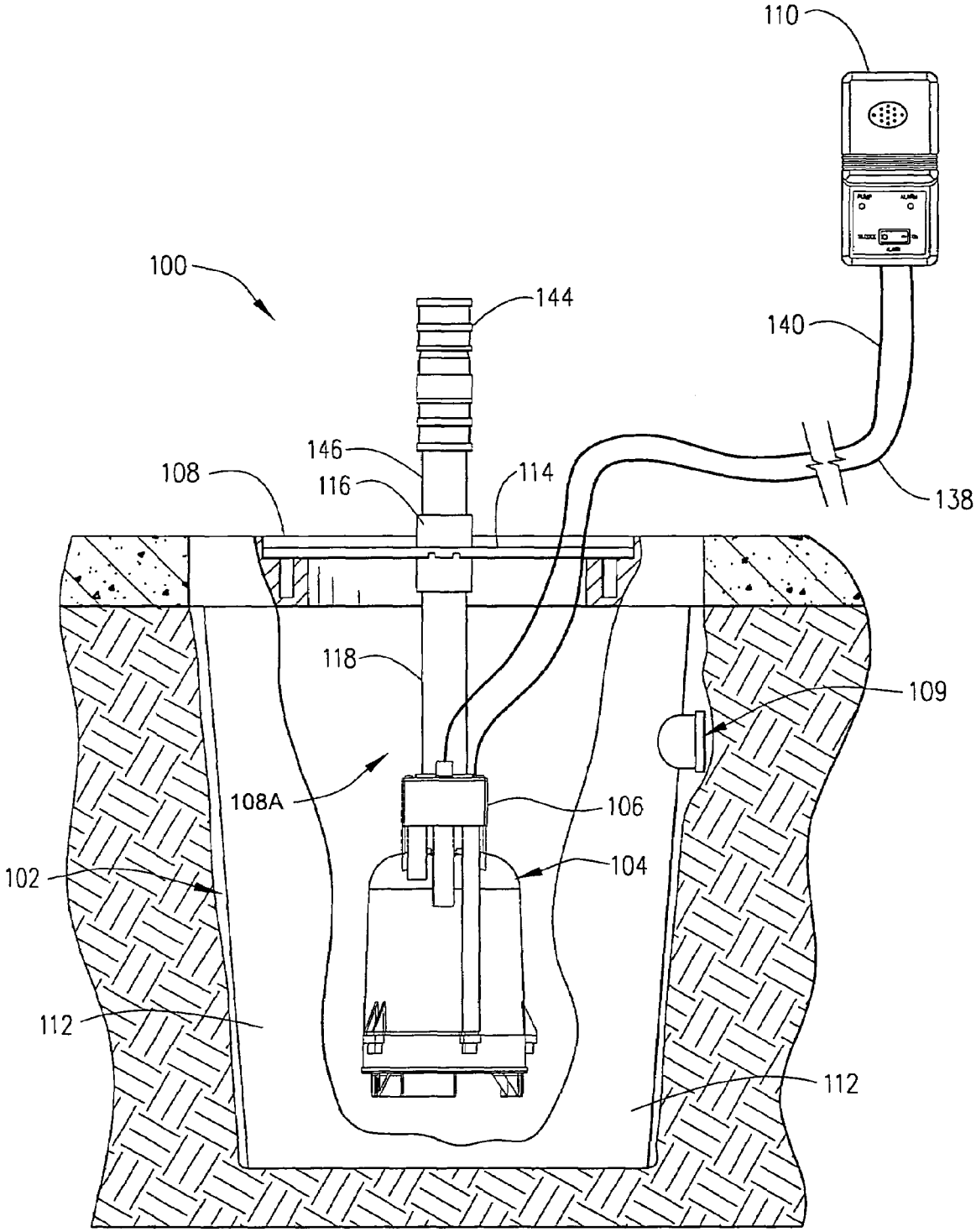
FIG. 1 is a partially cutaway, side elevation view of an automatic pump assembly constructed in accordance with a preferred embodiment of the present invention.

Referring to FIG. 1, shown therein is an automatic liquid collection and disposal assembly 100 that has been installed in an earthen pit 102. The automatic liquid collection and disposal assembly 100 includes a pump and motor assembly 104 with a liquid level detector 106 that are supported in a basin assembly 108 in the pit 102.

The basin 108 provides a collection cavity 108A for the accumulation of drainage liquids such as non-potable wastewater that enters a liquid entry port 109 that can be connected to a drainage conduit as required.

The automatic liquid collection and disposal assembly 100 has a control module 110 that is shown plugged into a nearby electrical outlet.

The construction and cooperative function of each of these components will be described with reference to FIG. 1 and with reference to the several other included figures in which the same number designations will be used to designate the components. Numerous details of construction will be omitted where such will be known to persons skilled in the art and are not believed necessary for a full understanding of the present invention.

The basin assembly 108 includes a basin 112 and basin cover 114. A plurality of fasteners (not separately designated) are used to fasten the basin cover 114 to the basin 112. Preferably, the basin assembly 108 is installed so that top rim of the basin 112 is flush with the top rim of the pit 102, and a concrete apron (not separately designated) poured around the top as shown.

The basin 112 is an open top vessel, and the basin cover 114 is preferably constructed of a transparent plastic such as polymethylmethacrylate or acrylonitrile-butadiene-styrene (ABS). The transparency of the basin cover 114 permits interior visual inspection of the basin 112 and the components of the automatic liquid collection and disposal assembly 100 disposed therein.

The dimensions and geometrical shape of the basin assembly 108 can be adapted to accommodate a variety of sizes and shapes of pits, such as illustrated by the pit 102. For example, the basin assembly 108 can include additional capacity, structural ribbing for greater strength and integrated lifting handles. The basin assembly 108 is for a single pump, such as the pump and motor assembly 104, and as discussed below, the basin assembly can be designed to accommodate more than one such pump and motor assembly.

The basin assembly 108 includes a mounting coupling 116 that is retained in an appropriately sized bore through the basin cover 114. The mounting coupling 116 is connected to an effluent discharge pipe 118 that in turn is connected to the pump and motor assembly 104. The effluent discharge pipe 118 has a first threaded end that makes up with a threaded connector output port of the pump and motor assembly 104. The other end of the effluent discharge pipe 118 has an outer surface that is smooth for mechanical adhesive bonding to the coupling 116. Thus, this arrangement of the coupling 116 and effluent discharge pipe 118 serve to support the pump and motor assembly 104 as shown.

The effluent discharge pipe 118 may also include an air relief vent hole (not shown). When the pump and motor assembly 104 is suspended from the basin cover 114 in the collection cavity 108A, the vent hole will be located so as to spray water down at approximately a 45 degree angle from horizontal; this will serve to evacuate air trapped in the pump and motor assembly 104 or the effluent discharge pipe 118. If employed, the vent hole should be located on the side of the effluent discharge pipe 118 away from the liquid level detector 106 to prevent false high water alarms potentially caused by the spray from the vent hole.

Preferably, the pump and motor assembly 104 is suspended by the effluent discharge pipe 118 and the coupling 116 from the basin cover 114 so that the bottom of the pump and motor assembly 104 is elevated a few inches above the bottom of the basin 112. Elevating the bottom of the pump and motor assembly 104 reduces the susceptibility of the pump and motor assembly 104 to potential clogging by debris that can collect in the bottom of the basin 112 as drainage liquid accumulates. The suspension of the pump and motor assembly 104 in this manner also reduces operational noise that can occur by vibration between the pump and motor assembly 104 and the basin 112.

Figure 2:
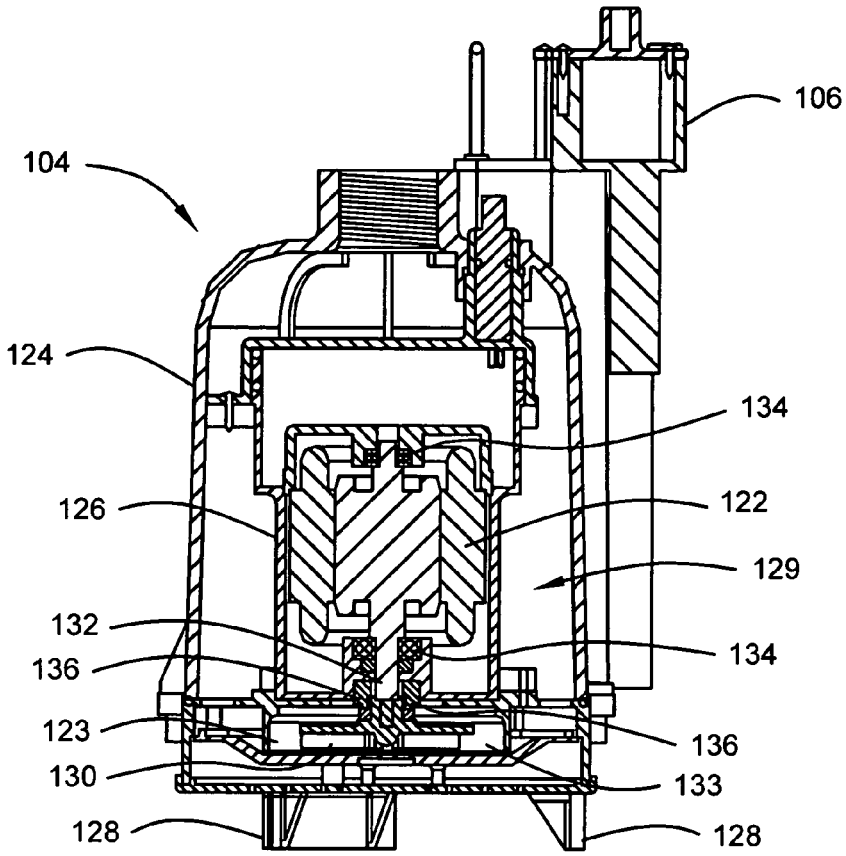
FIG. 2 is a side elevation, cross-section view of the pump of the automatic pump assembly of FIG. 1
Figure 3:
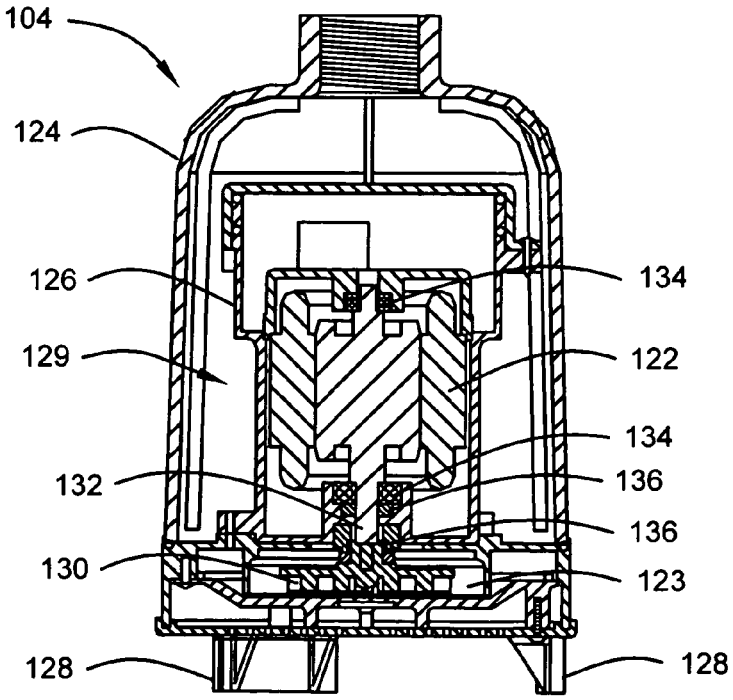
FIG. 3 is a front elevation, cross-section view of the pump of FIG. 2.

As shown in FIGS. 2 and 3, the pump and motor assembly 104 has an inlet screen 120, a motor 122, a pump 123, an outer shell or housing 124, an inner shell or housing 126 and a support stand 128. When pump and motor assembly 104 is suspended above the bottom of the basin 112, the support stand 128 will not contact the basin 112. However, when a particular application requires, the support stand 128 can be used to support the pump and motor assembly 104 on a supporting surface, such as the bottom of the basin 112. To minimize the introduction of debris into the pump and motor assembly 104, the support stand 128 has support legs dimensioned to elevate the bottom of the inlet screen 120 above the supporting surface should it be desirable in some applications to set the pump and motor assembly 104 on the bottom of the basin 108.

The outer shell 124 is preferably constructed from a strong plastic, such as acrylonitrile-butadiene-styrene (ABS) to eliminate corrosion and prolong the life of the pump and motor assembly 104. The inner shell 126, which surrounds the motor 122, is preferably constructed of a material having a high heat conductivity, such as an anodized, rigid aluminum, to dissipate heat from the motor 122. Many of the other hardware parts of the pump and motor assembly 104 are preferably made of stainless steel to minimize corrosion.

The outer and inner shells 124, 126 form an annular space 129 that forms a liquid path that communicates with a liquid outlet port (not separately designated) to which the effluent discharge pipe 118 is connected for a center discharge of the pump 123. The annular space 129 serves to direct effluent flow to the central liquid outlet port, and thus as an effluent discharge conduit for drainage liquid accumulated in, and pumped from, the pit 102. The annular space 129 also serves as a water jacket surrounding the motor 122 so that the motor 122 is cooled by the pump effluent. That is, the drainage liquid pumped from the basin 112 passes between the outer and inner shells 124, 126 around all sides of the motor 122, and because the motor 122 is water-cooled, the motor 122 does not require oil for lubrication or heat dissipation.

In a preferred embodiment, the motor 122 is a permanent split capacitor (PSC) motor contained within the fully submersible motor housing provided by the inner shell 126. It is preferred that the motor 122 exhibit a low amperage draw during use. For example, the motor 122 can be a ⅓ horsepower, 60 Hertz, 3450 RPM, single phase, 115 volt electric motor that draws 4.5 FLA (full load amps) during use. The use of the low amp draw motor 122 provides energy efficient operation and low operational costs.

The motor 122 has a drive shaft 132 on which is mounted a pump impeller 130 that is supported in a pump volute chamber 133 having an inlet protected by the inlet screen 120. The drive shaft 130 is preferably stainless steel and is supported for rotation by upper and lower ball bearings 134 that are shielded or sealed and permanently lubricated. The double ball bearings 134 provide for durable, efficient and quiet operation of the motor 122. The double ball bearings 134 also absorb the axial and radial thrust loads placed on the motor 122. The pump and motor assembly 104 also has two shaft seals 136 that prevent liquid entry into the motor 122. As constructed, the motor 122 is sealed and watertight.

The impeller 132 preferably has a semi-open, recessed vortex design that includes pump out vanes on the backside to help eliminate clogging by foreign material entering the volute chamber 133. The impeller 132 is molded around a brass insert (not numerically designated) and is balanced during manufacture. The brass insert is threaded, as is the end of the shaft 130, and with a permanent adhesive is mounted on the end of the shaft 130.

Figure 4:
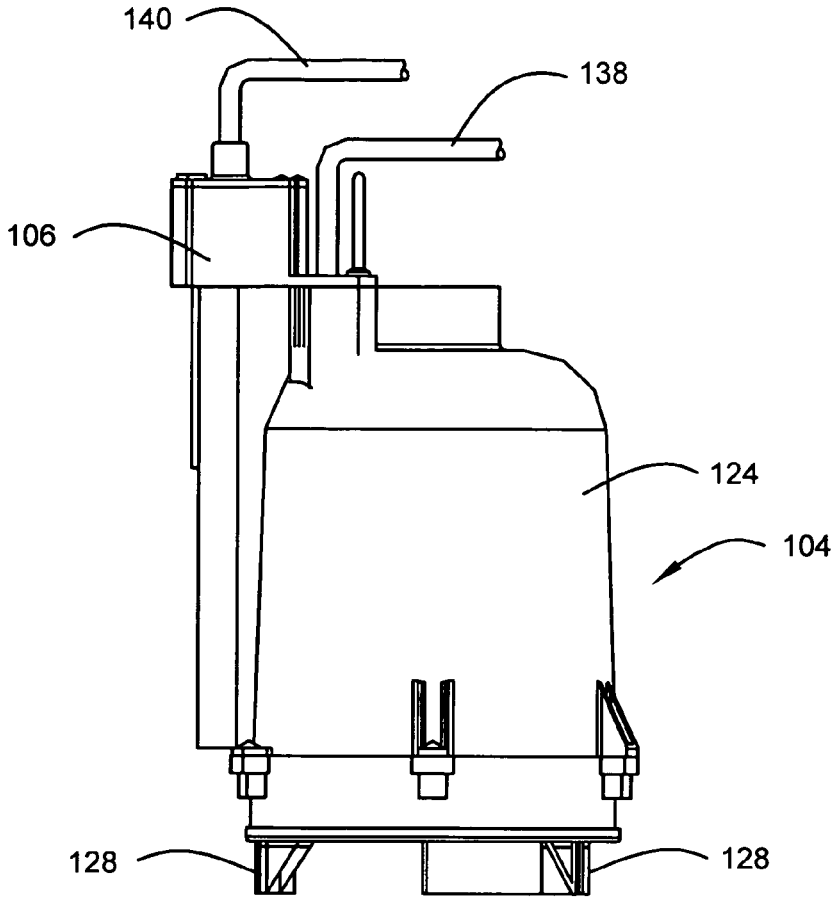
FIG. 4 is an elevation view of the other side of the pump of FIG. 2.

Turning to FIG. 4, the pump and motor assembly 104 has a power cord 138 and a control cord 140 electrically connected to the motor 122. The power cord 138 connects the motor 122 to an appropriate power supply, such as a conventional 115 volt residential electrical system. The control cord 140 provides electrical communication between the liquid level detector 106 and the control module 110, discussed below. Both cords 138, 140 are fully submersible and scalable to accommodate the conductivity requirements of a variety of applications.

Figure 5:
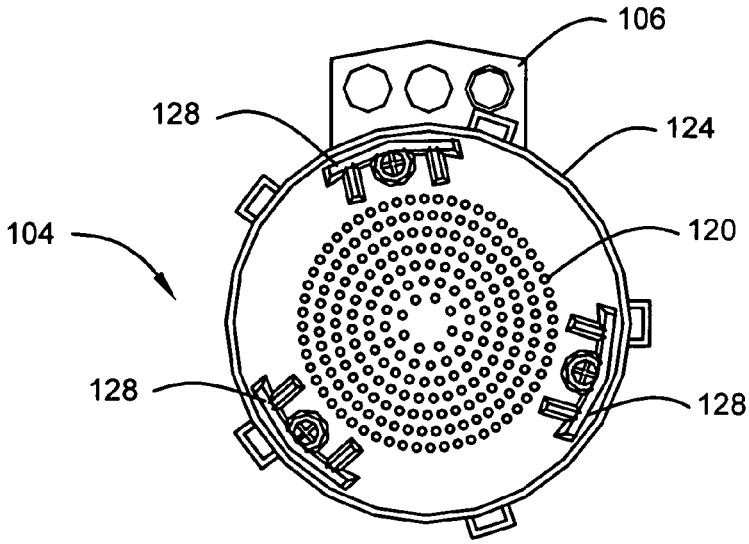
FIG. 5 is a bottom plan view of the pump of FIG. 2.

Referring to FIG. 5, shown therein is the inlet screen 120 that prevents debris from being drawn into the volute chamber 133. The inlet screen 120 is disposed on the bottom of the pump and motor assembly 104 and is preferably configured to prevent debris larger than about ⅛" from entering the volute chamber 133 of the pump and motor assembly 104. Also shown in FIG. 5 is the bottom of the liquid level detector 106.

Figure 6:
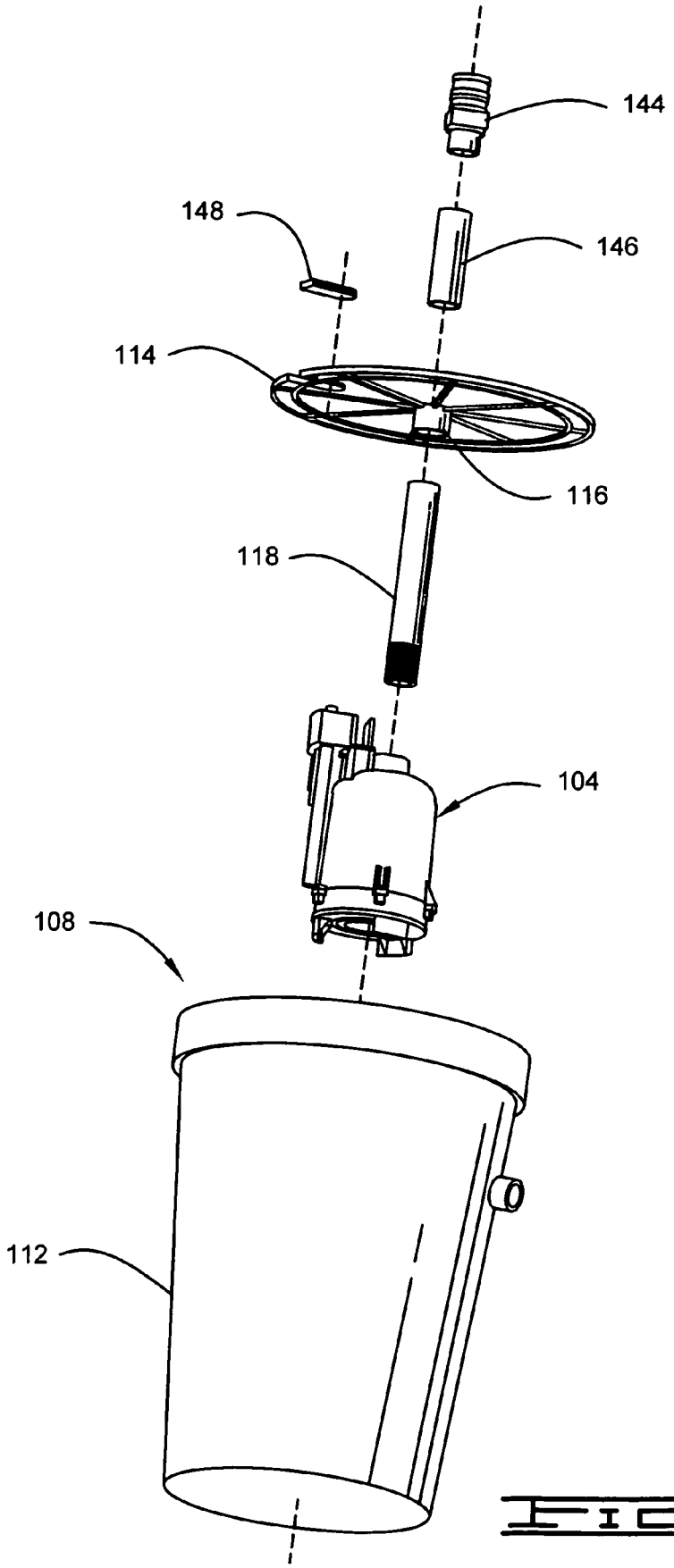
FIG. 6 is an exploded view of the automatic pump assembly of FIG. 1.

FIG. 6 is an exploded view showing the interconnection of various components of the automatic liquid collection and disposal assembly 100. As described above, the basin 112 supports the pump and motor assembly 104, which is connected to the effluent discharge pipe 118, which is in turn connected to the mounting coupling 116 of the basin cover 114. A check valve 144 is connected to the mounting coupling 116 by a second discharge pipe 146. Usually, this second discharge pipe 146 can be, for example, a 1½ inch NPT Schedule 80 pipe, smooth on both ends, with a connection on one end to the top of the mounting coupling 116 and the other end to the check valve 144.

Preferably, the second discharge pipe 146 is connected to the mounting coupling 116 and check valve 144 through conventional means, such as by adhesive bonding. The check valve 144 can be a 1½ inch NPT, flapper-style check-valve, having a transparent housing that permits visual inspection of the valve operation.

The basin cover 114 preferably includes a two-cord grommet 148 through which the power and control cords 138, 140 pass for entry into the basin 112 for connection to the motor 122 and liquid level detector 106, respectively.

In a typical application of the automatic liquid collection and disposal assembly 100 of the present invention, the pump and motor assembly 104 will be designed to produce 40 gallons per minute (GPM) at ten feet total dynamic head (TDH), with a maximum flow of 45 GPM at five feet TDH, and a maximum shutoff of thirty-two feet TDH. It will be understood that the size, scale and configuration of the pump and motor assembly 104 can be modified for various applications and that such modifications are within the scope of the present invention.

Figure 7:
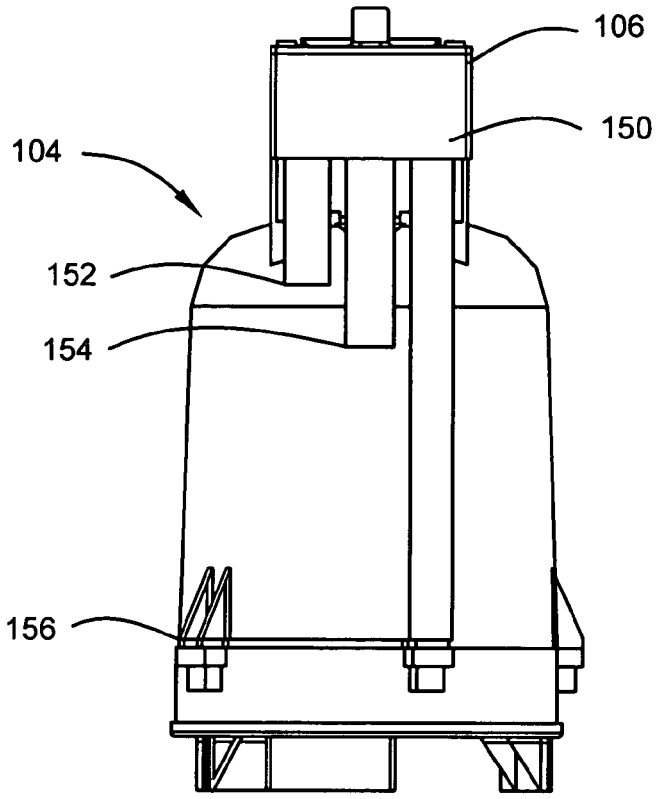
FIG. 7 is a rear elevation view of the pump of FIG. 2.

Referring now to FIG. 7, which provides the best view of the liquid level detector 106, it will be noted that the liquid level detector 106 has a sensor housing 150 and three probes, an upper limit probe 152, an intermediate limit probe 154 and a lower limit probe 156, extending downwardly there from. The probes 152, 154, 156 are conventional capacitance probes that detect the presence of drainage liquid, usually non-potable water, at the lower end of each such probe.

The motor 122 and the liquid level detector 106 are connected to the control module 110 by the power cord 138 and the control cord 140, respectively. The control module 110 is constructed in accordance with the teaching of U.S. Pat. No. 5,238,369 issued to Farr and entitled "Liquid Level Control With Capacitive Sensors," which is incorporated by reference herein. Accordingly, it is believed not to be necessary to further describe the structure of the control module 110 as such will be readily understood by one skilled in the art of liquid level controllers. The operation of the control module 110, and the cooperating functions of the limit probes 152, 154 and 156, will be described below.

As shown, the upper limit probe 152 is the highest (measured from the base of the pump and motor assembly 104), the intermediate limit probe 154 is the next highest, and the lower limit probe 156 is the lowest. The probes 152, 154 and 156 are preferably made from a durable thermoplastic to resist corrosion, and each is sealed with epoxy above the capacitance plate mechanisms contained in the lower end to prevent moisture from reaching and condensing inside the sensor housing 150.

Figure 8:
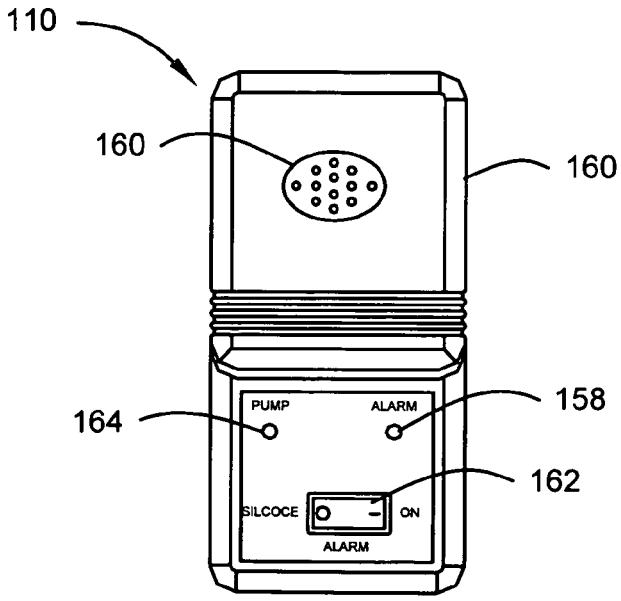
FIG. 8 is a front view of the control module of the automatic pump assembly of FIG. 1.

The control module 110, shown more clearly in FIG. 8, is configured to apply electrical power to the motor 122, and thus to the pump 123, in response to a signal from the liquid level detector 106 when the intermediate limit probe 154 detects that the level of drainage liquid in the basin 112 has accumulated to a depth that reaches the bottom of the intermediate limit probe 154. Once the pump 123 is activated, the drainage liquid level will normally be lowered, and when the level of the drainage liquid in the basin 112 drops below the bottom of the lower limit probe 156, the control module 110 powers down the motor 122 and pump 123.

Should the level of drainage liquid continue to rise in the basin 112 to reach and be detected by the upper limit probe 152, the control module 110 will turn on an alarm light 158 that will remain illuminated until the level is reduced to below the bottom of the upper limit probe 152.

When the alarm light 158 is illuminated due to detection of a high drainage liquid level by the upper limit probe 152, the control module 110 also turns on a high water alarm horn 160. A toggling rocker-style silencer switch 162 is provided on the control module 110 to turn off the sound of the alarm horn 160. That is, the audible warning sound of the alarm horn 160 can be silenced by toggling the rocker-style silencer switch 162 to its silence position. Even if the alarm horn 160 is thusly silenced, the alarm light 158 will remain illuminated on the automatic liquid collection and disposal assembly 100 until serviced, such as by a plumber to determine and remove the cause of the high level drainage liquid. Once the alarm situation has been remedied, the silencer switch 162 will be returned to its on position to place the alarm horn 160 back into service.

The control module 110 has a run light 164 that automatically turns on when the pump and motor assembly 104 is operational, and that automatically turns off when the pump and motor assembly 104 is not operating. The control module 110 should be sufficiently encased and sealed in an impact resistant plastic housing so as to be rated for indoor use, having a standard, three-prong 115 volt plug (not shown) for connection to a standard 115 volt household electrical outlet.

Figure 9:
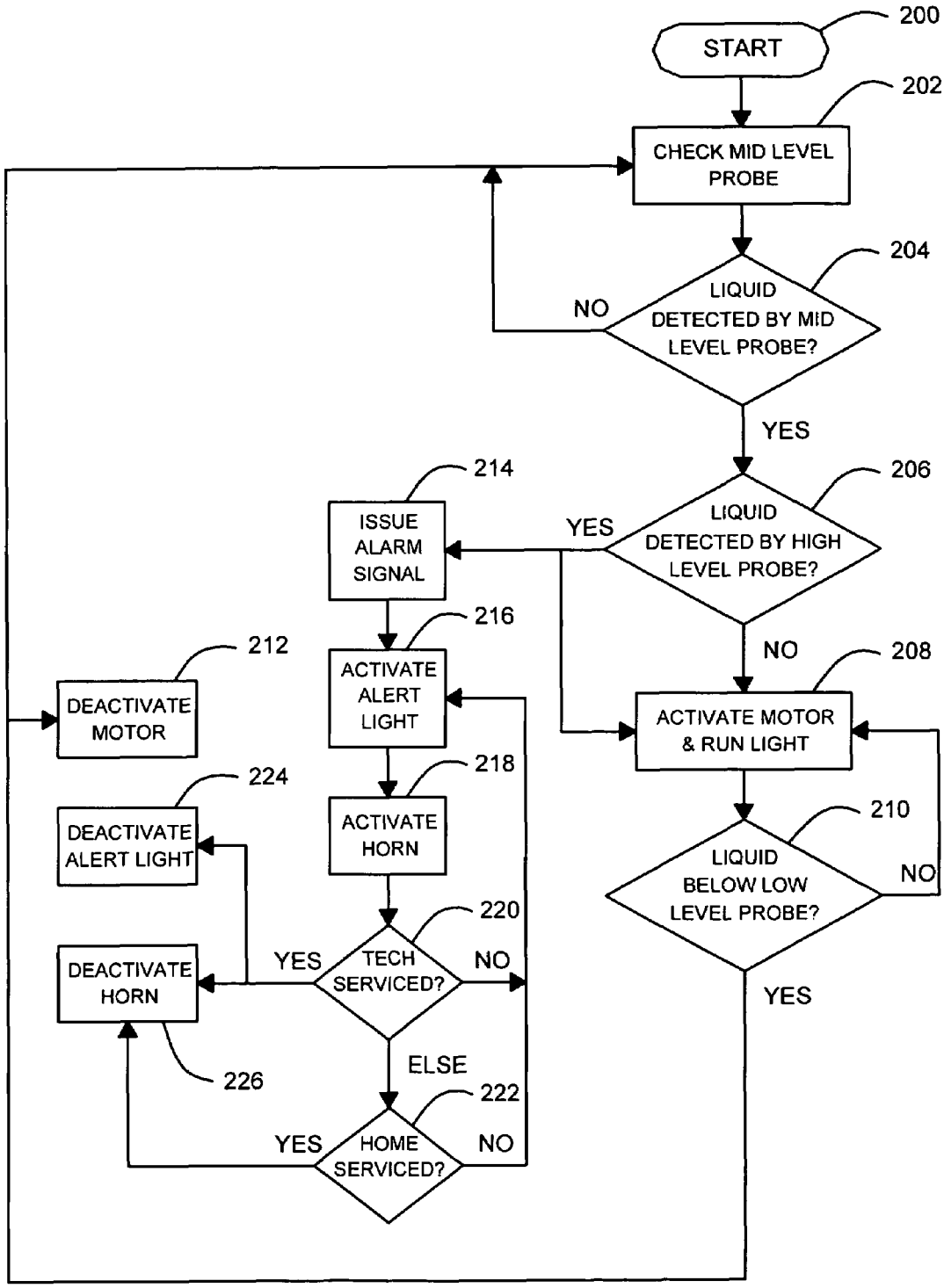
FIG. 9 is a flowchart of the control steps for the pump system of FIG. 1.

A flow chart depicting the operation of the automatic pump system 100 carried out according to preferred embodiments of the present invention is shown in FIG. 9. Beginning at step 200, the control module 110 checks the mid-level probe 154 at step 202, and if liquid is detected at step 204, the liquid level is checked at the high level probe at step 206. If the answer is no at step 206 (liquid is not detected at the high level probe), the motor 122, and thus the pump 123, is activated at step 208, which also turns on the run light 164. At step 210, the query of whether the liquid level is below the low level probe is made, and if the answer is yes, the motor 122 is deactivated at step 212.

If at step 204 the answer to the query of whether the liquid level is detected at the mid level probe 154 is no, the loop query returns to step 202, and the motor 122 is not activated.

At step 206, if the query of whether the liquid level is detected by the high level probe 154 is yes, this means there is either a malfunction of the motor 122 (it did not turn on when activated) or the flow of incoming drainage liquid into the collection chamber is greater than the pump 123 can handle. Then, at step 206, a yes answer causes an alarm signal to issue at step 214, which turns on the alert light 158 at step 216 and turns on the audible alarm horn 160 at step 218.

When an alarm condition has occurred as signaled by the alert light 158 at step 216 and the audible alarm horn at step 218, it is expected that liquid collection and disposal assembly 100 will require service either by the owner or by a professional, technical service person. The system is configured so that the owner can easily turn off the audible alarm horn by toggling switch 162, but the owner cannot turn off the alert light 158, which will remain illuminated until the pump system 100 has received professional technical service. That is, the alert light 158 can be turned off externally and must be reset by one with the skill of entering the control module 110.

The control module 110 makes the query of whether the service has received a technical service call by a designated professional person at step 220, or whether it has received a home service by the owner at step 222. If at step 220, the answer is yes, the alert light 158 will be deactivated at step 224 and the audible alert horn turned off at step 226. However, if no technical service (to remove and abate a failure condition) has been received, the answer at step 220 will be no, and both the alert light 158 and the audible alert horn 160 will stay on at steps 216 and 218, respectively.

At step 222, if the query by the control module as to whether home service has occurred is yes, the audible alert horn 160 will have been deactivated as at step 226. If the answer at step 222 is no, both the alert light 158 and the audible alert horn 160 will continue to be activated as at steps 216 and 218, respectively.

The control of the automatic pump system 100 by the control module 110 thus assures that the motor 122 is activated as necessary to keep the level of the drainage liquid in the collection chamber is maintained no higher than the mid level probe during normal operation. But should the level of drainage liquid in the collection chamber be detected at or above the high level probe, emergency conditions will be declared and both a visual and audible alarm will be activated until the pump system 100 receives attention by one capable of removing the cause of the failure. The owner can shut off the audible alert horn 160, but cannot turn off the visual alert light 158; this assures that, even if the system has not received professional servicing, the continuously illuminated alert light 158 will inform the service person that a high level condition has occurred since the last professional service call.

In an alternate embodiment, the automatic liquid collection and disposal assembly 100 includes an auxiliary power system (APS), to provide continued pump availability during electrical power outages. The APS includes a battery in addition to the components included in the control module 110 described above. Preferably, the battery is a deep cycle, 12 volt battery commonly found in marine applications. When using the APS, the control module 110 is plugged directly into the APS, which in turn, is plugged into a standard 115 volt household electrical outlet. Should an electrical outage occur, the APS system provides backup power to the motor 122 from the battery. When online electrical power has been restored, the APS system switches back to the online supply. The APS system may also include a battery charger to ensure the readiness of the auxiliary battery.

In another preferred embodiment of the present invention, the pump system of the present invention will include additional pumps 123 for high-capacity installations. For such installations, multiple pumps 123, discharge pipes 118, 146 with check valves 144, mounting couplings 116, cord grommets 148 and power and control cords 138, 140 will be provided as necessary. The multiple installation can be controlled using one or more level detectors 106 (for redundancy) and a control module 110 adapted to control the multiple pumps 123. The multiple pump installation preferably will include duplex pump alternators to automatically alternate pump operation between cycles to extend operational lives of the pumps and to provide back-up in the event of pump failure.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed and as defined in the above text and in the accompanying drawings.

What is claimed is:

1. A liquid collection and disposal assembly for collecting and disposing of drainage liquid, comprising:

a basin assembly having a collection cavity to collect the drainage liquid and a cover;

a pump and motor assembly comprising:

a pump having an outer housing and an inner housing forming a liquid flow path between the outer and inner housings, the pump having a discharge port;

a motor powering the pump and disposed in the inner housing and sealed from the liquid flow path;

means for detecting the level of drainage liquid in the collection cavity, comprising:

a lower limit probe;

an intermediate limit probe; and an upper limit probe for detecting liquid levels, and control means responsive to the level detector means for activating the motor means to power the pump to determine the liquid level in the collection cavity, the control means issuing an activate motor signal when liquid is detected by the intermediate limit probe, and the control means issuing an alarm signal when liquid is detected by the high level probe, the control means comprising a control module having an alert light and an audible alarm that are activated by the alarm signal; and means for supporting the pump and motor assembly in the collection cavity, comprising:

a mounting coupling supported by the cover and extending therethrough; and a discharge pipe having one end connected to the mounting coupling and another end connected to the discharge port, the mounting coupling and discharge pipe supporting the pump and motor assembly from the cover for removable placement a predetermined distance above the bottom of the basin assembly.

2. The liquid collection and disposal assembly of claim 1 wherein the cover is constructed of a substantially transparent material.

3. The liquid collection and disposal assembly of claim 2 further comprising a check valve connected to an upper end of the mounting coupling.

4. The liquid collection and disposal assembly of claim 3 wherein the check valve has a housing that is at least partially transparent.

5. The liquid collection and disposal assembly of claim 4 wherein the inner housing of the pump is made of a material having a high heat conductivity so that thermal energy from the motor while operating is transferred to liquid flowing through the liquid flow path.

6. The liquid collection and disposal assembly of claim 5 wherein the control module has an electrical plug that is receivable by a household electrical receptacle.

7. The liquid collection and disposal assembly of claim 1 wherein the motor has a drive shaft, and wherein the pump comprises:

a volute chamber having an inlet and outlet;

an impeller supported by the drive shaft for rotation in the volute chamber;

an inlet screen supported on the inlet of the volute chamber; and a support stand extending downwardly from the inlet screen.

8. The liquid collection and disposal assembly of claim 1 wherein the control module has a power cord and a control cord connected to the pump and motor assembly, and wherein the basin assembly further comprises:

a grommet supported by the basin providing access to the collection cavity of the basin, the power cord and the control cord extending through the grommet.

9. A liquid collection and disposal assembly for collecting and disposing drainage liquid, comprising:

a basin having a collection cavity in liquid communication with the pit, the basin having a cover over the collection cavity, a pump and motor assembly comprising:

a pump having an outer housing and an inner housing forming a liquid flow path between the outer and inner housings;

a motor powering the pump and disposed in the inner housing and sealed from the liquid flow path; and means removably connecting the pump to the cover, the pump and motor assembly supported by the cover for removable placement in the basin a predetermined distance above the bottom of the basin;

level detector means for detecting when the liquid level reaches predetermined levels in the collection cavity, the level detector means having a lower limit probe, an intermediate limit probe and an upper limit probe for detecting liquid levels; and control means responsive to the level detector means for activating the motor means to power the pump, the control means issuing an activate motor signal when liquid is detected by the intermediate limit probe, the control means issuing an alarm signal when liquid is detected by the high level probe, and the control means has an alert light and an audible alarm that are activated by the alarm signal.

10. The liquid collection and disposal assembly of claim 9 wherein control means comprises a control module having an alert light that is activated by the alarm signal.

11. The liquid collection and disposal assembly of claim 10 wherein the control module has an audible alarm that is activated by the alarm signal.

12. The liquid collection and disposal assembly of claim 11 wherein the means for removably connecting the pump to the cover comprises:

a mounting coupling supported by the basin cover and extending therethrough; and a discharge pipe having one end connected to a lower end of the mounting coupling and another end connected to a discharge port of the pump, the mounting coupling and discharge pipe supporting the pump and motor assembly in the collection cavity.

13. The liquid collection and disposal assembly of claim 12 further comprising a check valve connected to an upper end of the mounting coupling.

14. The liquid collection and disposal assembly of claim 13 wherein the basin cover is transparent.

15. The liquid collection and disposal assembly of claim 14 wherein the check valve has a transparent housing.

16. The liquid collection and disposal assembly of claim 15 wherein the inner housing is made a material having a high heat conductivity so that thermal energy from the motor while operating is transferred to liquid flowing through the liquid flow path between the inner and outer housings.

17. The liquid collection and disposal assembly of claim 16 wherein the control module has an electrical plug that is receivable by a household electrical receptacle.

18. The liquid collection and disposal assembly of claim 12 wherein the motor has a drive shaft, and wherein the pump comprises:

a volute chamber having an inlet and outlet;

an impeller supported by the drive shaft for rotation in the volute chamber;

an inlet screen supported on the inlet of the volute chamber; and a support stand extending downwardly from the inlet screen.

19. The liquid collection and disposal assembly of claim 11 wherein the control module has a power cord and a control cord connected to the pump and motor assembly, and wherein the basin assembly further comprises:

a grommet supported by the basin providing access to the collection cavity of the basin, the power cord and the control cord extending through the grommet.

20. A liquid collection and disposal assembly for collecting drainage liquid in a pit, comprising:

a basin disposable in the pit and having a collection cavity in liquid communication with the pit, the basin having a transparent cover over the collection cavity;

a pump and motor assembly;

a pump having a discharge port;

a motor powering the pump and sealed from the liquid; and means removably connecting the pump to the cover, the pump and motor supported by the cover in the basin a predetermined distance above the bottom of the basin, said means comprising:

a mounting coupling connected to the cover and extending therethrough; and a discharge pipe having one end connected to the mounting coupling and mounting another end connected to the discharge port of the pump, the coupling and discharge pipe supporting the pump and motor assembly from the cover for removeable placement in the collection cavity of the basin;

means for detecting when the liquid level reaches predetermined levels in the collection cavity, the level detector means having a lower limit probe, an intermediate limit probe and an upper limit probe for detecting liquid levels; and control means responsive to the level detector means for activating the motor means to power the pump, the control means issuing an activate motor signal when liquid is detected by the intermediate limit probe and issuing an alarm signal when liquid is detected by the high level probe, the control means having an alert light and an audible alarm activated by the alarm signal.

* * * * *

UNITED STATES PATENT AND TRADEMARK OFFICE

CERTIFICATE OF CORRECTION

PATENT NO. : 7,264,449 B1
APPLICATION NO. : 11/250642
DATED : September 4, 2007
INVENTOR(S) : Harned et al.

It is certified that error appears in the above-identified patent and that said Letters Patent is hereby corrected as shown below:

At Column 10, line 19, “made a” should be -- made of a --.

At Column 10, line 53, “means removably” should be -- means for removably --.

Signed and Sealed this

Eighth Day of July, 2008

JON W. DUDAS
*Director of the United States Patent and Trademark Office*